United States Patent [19]

Okochi et al.

[11] Patent Number: 4,812,997

[45] Date of Patent: Mar. 14, 1989

[54] CONTROL APPARATUS FOR AN AIR CONDITIONING SYSTEM

[75] Inventors: Kastuhiko Okochi, Shiga; Mitsuo Toya, Otsu; Masahito Naito, Uji; Yoshiaki Inoue; Takahiro Egusa, both of Kusatsu, all of Japan

[73] Assignee: Daikin Industries, Ltd., Osaka, Japan

[21] Appl. No.: 36,428

[22] Filed: Apr. 9, 1987

[30] Foreign Application Priority Data

Apr. 10, 1986 [JP] Japan ..... 61-82556

[51] Int. Cl.[4] ..... G06F 15/20; F28F 27/00

[52] U.S. Cl. ..... 364/505; 165/12; 165/22; 236/1 EA

[58] Field of Search ..... 364/505, 506, 550; 165/13, 14, 22, 27; 236/1 B, 1 C, 1 E, 1 EA, 61, 91 E; D23/139, 141

[56] References Cited

U.S. PATENT DOCUMENTS

| | | | |
|---|---|---|---|
| 4,173,754 | 11/1979 | Feiker | 364/505 |
| 4,217,646 | 8/1980 | Caltagirone | 364/505 |
| 4,276,925 | 7/1981 | Palmieri | 364/505 |
| 4,307,576 | 12/1981 | Takano et al. | 62/204 |
| 4,332,013 | 5/1982 | Chelcun et al. | 364/505 |
| 4,373,662 | 2/1983 | Bassett et al. | 364/505 |
| 4,463,574 | 8/1984 | Spethmann et al. | 364/505 |
| 4,661,914 | 4/1987 | Mulokey et al. | 364/505 |

FOREIGN PATENT DOCUMENTS

| | | |
|---|---|---|
| 58-127055 | 7/1983 | Japan . |
| 2038036 | 7/1980 | United Kingdom . |

*Primary Examiner*—Parshotam S. Lall
*Assistant Examiner*—Brian M. Mattson
*Attorney, Agent, or Firm*—Birch, Stewart, Kolasch & Birch

[57] ABSTRACT

A control apparatus for an air conditioning system has an outdoor unit with a compressor, a condenser and a plurality of motorized valves installed to a plurality of branch pipings. A plurality of indoor units having, a plurality of indoor thermoswitches, a microcomputer, and a drive circuit for driving the motorized valves according to the output from the microcomputer are also provided for the control apparatus. The microcomputer counts the number of indoor units required for operation by receiving the output from the indoor thermoswitch. The microcomputer also controls the opening of the motorized valves by predetermined opening steps, according to the result of the counting and with reference to an opening table. The opening table relates the number of indoor units required for operation with the opening of each of the motorized valves. The control apparatus thus permits an optimum distribution of refrigerant to the indoor units to be set quickly.

4 Claims, 5 Drawing Sheets

Indoor Unit A
42
41
Evaporator
F
(A)
(B)
(C)
(D)
(E)
9a
9b
9c
9d
9e
8a
8b
8c
8d
8e
EV
7a
7b
7c
7d
7e
15a
15b
15c
15d
15e
14a
14b
14c
14d
14e
6
Filter
5
4
Filter
2
3
Condenser
13
12 Accumulator
11 Accumulator
10
17
16
1

CONTROL APPARATUS FOR AN AIR CONDITIONING SYSTEM

BACKGROUND OF THE INVENTION

The present invention relates to a control apparatus for an air conditioning system and more particularly to a control apparatus having motorized valves for an air conditioning system designed to serve a plurality of rooms at one time with its outdoor unit connected to a liquid refrigerant pipe of which is divided into a plurality of branches which are to be connected to a plurality of indoor units.

A type of control apparatus for an air conditioning system designed to control the circulation of refrigerant to indoor units by motorized valves installed in the refrigerant circuit of outdoor unit is described in Japanese Laid-Open Patent Publication No. 127055/1983. The control apparatus of the air conditioning system is designed so that the saturation temperature of suction gaseous refrigerant and the temperature of suction gaseous refrigerant are detected by temperature sensors to detect the quantity of superheat, and the detected signals are fed back to control the opening of motorized valves and adapt the cooling capacities of indoor units to variation of load and difference of piping length.

However, such a conventional control apparatus is disadvantageous in that its production cost is relatively high because it requires a complicated control circuit to enable the feedback control with PID (proportional integral and differential) control action, for example, and a refrigerant circuit with a temperature sensor.

SUMMARY OF THE INVENTION

The object of the present invention is to provide a control apparatus for an air conditioning system having a plurality of motorized valves installed in branch pipings and serving a plurality of rooms at a time, featuring its simple and inexpensive refrigerant circuit and control circuit.

In order to attain the object, the control apparatus for an air conditioning system according to the present invention comprises an outdoor unit which has a compressor, a condensor to receive the refrigerant transferred from said compressor, a liquid refrigerant piping having one end connected to said condensor and the other end divided into a plurality of branch pipings and motorized valves for controlling the quantity of refrigerant which are installed respectively to said branch pipings; a plurality of indoor units having their respective evaporators, which are respectively connected to the branch pipings; an operation request signal output means for outputting the operation request signal to indicate whether or not any of the plural number of indoor units is required to operate; a counting means for counting the number of indoor units required their own operations which are determined according to the output from said operation request signal output means; an opening control means which is provided with an opening table for relating at least the number of indoor units required to operate with the opening of motorized valves corresponding to the indoor units and outputs the signals to indicate the opening of the motorized valves in reference to the opening table and according to the result of the counting by the counting means; and a drive circuit to output the signals for driving the motorized valves according to the output from the opening control means.

According to the control apparatus, when the output from operation request signal output means is inputted to the counting means, it counts the number of indoor units which are required to be operated. When the output from the counting means is inputted to the opening control means, it controls the opening of the motorized valve installed in each of branch pipings by steps to the opening determined according to the opening table which relates the number of indoor units of which operation is required to the opening of the motorized valve, whereby the optimum distribution of refrigerant to the indoor units can be set quickly and the control circuit can be extremely simplified, and the refrigerant circuit with temperature detector is not required. As a result, a compact design and low production cost for the control apparatus can be realized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

This objects and features of the present invention will become apparent from the following description taken in conjunction with the accompanying drawings which are given by way of illustration only, and thus are not limitative of the present invention, and in which.

Before the description of embodiments of the present invention, it is to be noted that like parts are designated by like reference numerals througout the several views of the accompanying drawings.

DETAILED DESCRIPTION OF THE PREFERRED EMBODIMENTS

One of the embodiments of the present invention will now be explained with reference to FIGS. 1 through 5.

Figures 1A, 1B:
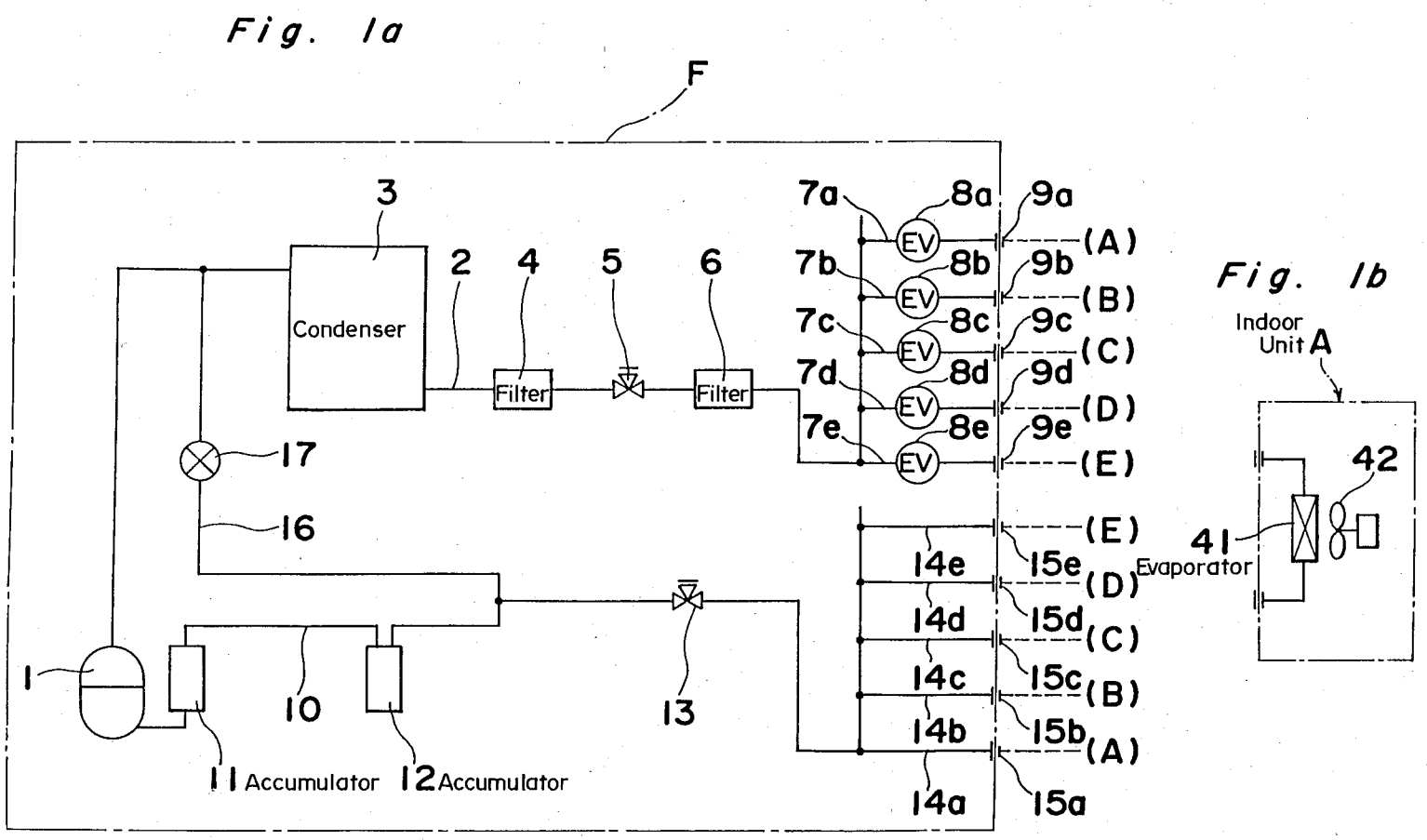
FIG. 1*a* is a schematic view of a refrigerant piping system of an embodiment of the present invention.
FIG. 1*b* is a schematic view of an indoor unit.

Initially, to explain the refrigerant circuit of outdoor unit F with reference to FIG. 1*a*, a discharge outlet of compressor 1 is connected to a condensor 3. A filter 4, a stop valve 5 and a filter 6 are installed in a liquid refrigerant piping 2 that extends from the condensor 3. The refrigerant piping 2 is divided into a plurality of branch pipings 7*a*, 7*b*, 7*c*, 7*d* and 7*e* corresponding to the indoor units A, B, C, D and E connected respectively to connecting ports 9a, 9b, 9c, 9d and 9e. Each of these branch pipings 7*a*, 7*b*, 7*c*, 7*d* and 7*e* has a respective motorized valve 8*a*, 8*b*, 8*c*, 8*d* or 8*e* installed thereon. Each motorized valve 8*a*, 8*b*, 8*c*, 8*d* or 8*e* is operated by, for example, a stepper motor.

Accumulators 11 and 12 and a stop valve 13 are installed to gaseous refrigerant piping 10 connected to the suction inlet of the compressor 1. The gaseous refrigerant piping 10 is divided into a plurality of branch pipings 14*a*, 14*b*, 14*c*, 14*d* and 14*e* in order to be connected, respectively, to connecting ports 15*a*, 15*b*, 15*c*, 15*d* and 15*e*. The inlet of condensor 3 of the liquid refrigerant piping 2 and the inlet of accumulator 12 of gaseous refrigerant piping 10 are connected by bypass piping 16 with a low pressure regulating valve 17 installed in the middle of the bypass piping.

The connecting ports 9*a*, 9*b*, 9*c*, 9*d* and 9*e* on the side of the liquid refrigerant piping 2 and the connecting ports 15*a*, 15*b*, 15*c*, 15*d* and 15*e* on the side of the gaseous refrigerant piping 10 are connected to each other through indoor units A, B, C, D and E. As shown in FIG. 1*b*, the indoor unit A is provided with an evaporator 41 and a fan 42. The indoor units B, C, D and E have the same construction as that of the indoor unit A.

Figure 2:
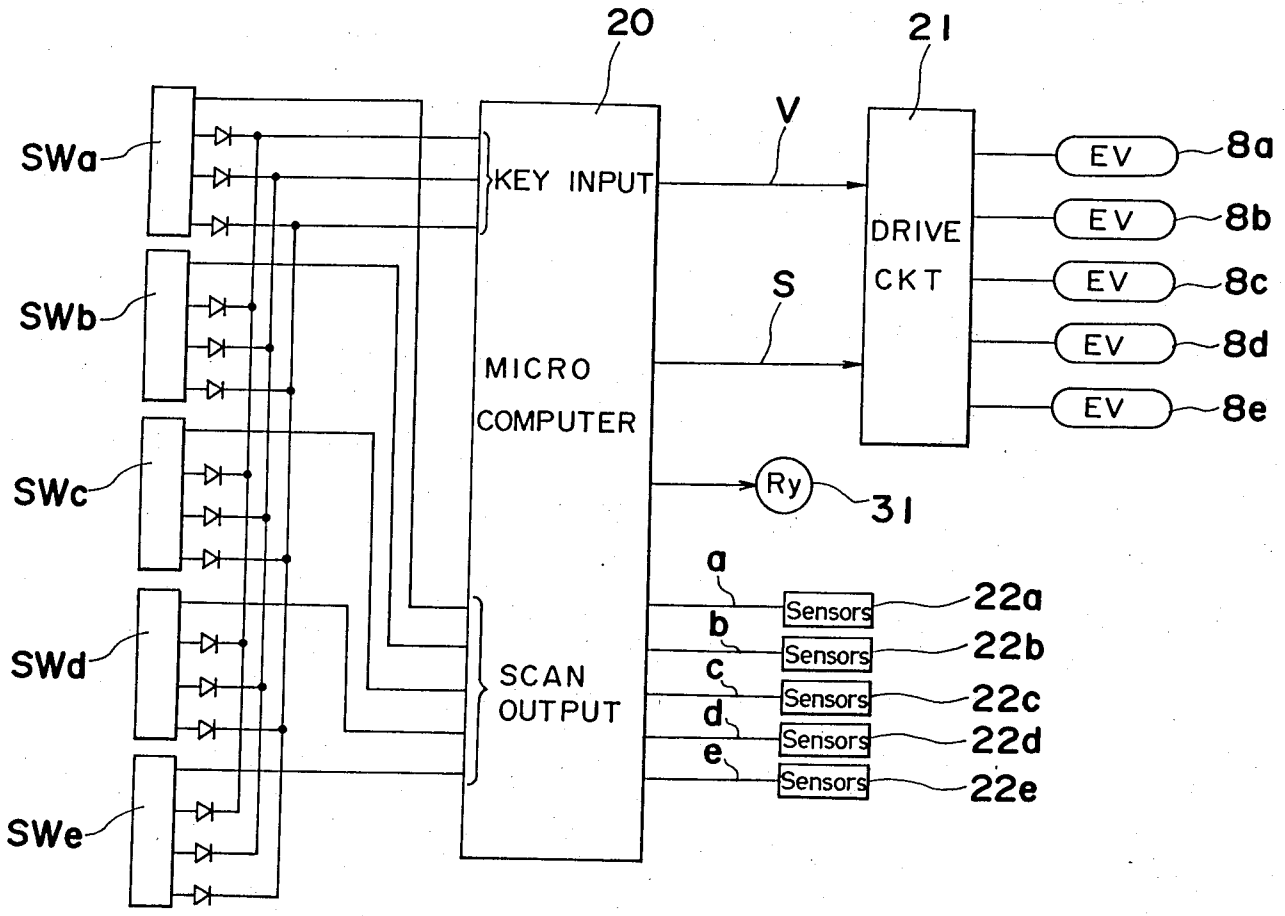
FIG. 2 is a block diagram of a control apparatus of the invention.

The construction of a control apparatus to control the opening of the motorized valves 8*a*, 8*b*, 8*c*, 8*d* and 8*e* will be explained with reference to FIG. 2. The opening for each of the motorized valves 8*a*, 8*b*, 8*c*, 8*d* and 8*e* is controlled, respectively, by a drive circuit 21 that is operated by a valve signal V to determine the motorized valve to be actuated and an opening signal S to determine the opening of each of the motorized valves which are outputted from a microcomputer 20. The microcomputer 20 is designed to receive not only the input of operation request signals a, b, c, d and e which are to determine the units to be operated out of indoor units A, B, C, D and E and outputted from indoor thermoswitches 22*a*, 22*b*, 22*c*, 22*d* and 22*e* as operation request signal output means but also the setting signals set by selection switches SW*a*, SW*b*, SW*c*, SW*d* and SW*e* which are provided corresponding to indoor units A, B, C, D and E. The selection switches SW*a*, SW*b*, SW*c*, SW*d* and SW*e* are scanned by the microcomputer 20.

In this embodiment, the operating conditions of air conditioning system are determined by said thermoswitches i.e. sensors 22*a*, 22*b*, 22*c*, 22*d* and 22*e* and selection switches SW*a*, SW*b*, SW*c*, SW*d* and SW*e*. The selection switches SW*a*, SW*b*, SW*c*, SW*d* and SW*e* include capacity setting means and piping-length setting means and are designed so that they can be used for selecting and setting of the combinations of the capacities of the indoor units A, B, C, D and E and the lengths of pipings reaching to said indoor units A, B, C, D and E by selecting desired contact points out of their contact points after an air conditioning system is installed. For example, where the air conditioning system is capable of operating at any of three different capacities such as 2200 kcal/h, 3500 kcal/h and 4500 kcal/h, and the pipings of more than 15 m and less than 15 m are available, each of the selection switches is designed to select the combination of the operating capacity and piping length. Such combination can be selected at the time of the installation of indoor units A, B, C, D and E. In this case, there are six selectable combinations. In the case shown in FIG. 2, however, there are eight selectable combinations, since there are three input terminals.

The microcomputer 20 stores the data A, (j, k) concerning the opening of motorized valves corresponding to combinations of number of indoor units in operation, capacities of indoor units and piping lengths as shown in the following table. That is, the microcomputer stores the data listed in the following table and includes an opening control means for setting the openings of the motorized valves according to the data of the table. The microcomputer also includes a counting means for counting the number of indoor units which are required to be operated according to the outputs from the sensors 22*a*, 22*b*, 22*c*, 22*d* and 22*e*.

TABLE 1

| Capacity of indoor unit | Piping-length | Number of indoor unit required operation (j) 1 | 2 | 3 | 4 | 5 |
|---|---|---|---|---|---|---|
| Small | Short | A(1.0) | A(2.0) | A(3.0) | A(4.0) | A(5.0) |
| | Long | A(1.1) | A(2.1) | A(3.1) | A(4.1) | A(5.1) |
| Medium | Short | A(1.2) | A(2.2) | A(3.2) | A(4.2) | A(5.2) |
| | Long | A(1.3) | A(2.3) | A(3.3) | A(4.3) | A(5.3) |
| Large | Short | A(1.4) | A(2.4) | A(3.4) | A(4.4) | A(5.4) |
| | Long | A(1.5) | A(2.5) | A(3.5) | A(4.5) | A(5.5) |

The opening control means for motorized valves is designed so that the opening of motorized valves 8*a*, 8*b*, 8*c*, 8*d* and 8*e* can respectively be controlled to the predetermined opening A (j, k) by steps, according to the number of indoor units in operation detected by the inputs a, b, c, d, e from the sensors 22*a*, 22*b*, 22*c*, 22*d* and 22*e*, the capacities of indoor units A, B, C, D and E and the lengths of pipings reaching the indoor units, respectively, which are detected by the input signals from the selection switches SW*a*, SW*b*, SW*c*, SW*d* and SW*e*.

Figure 3:
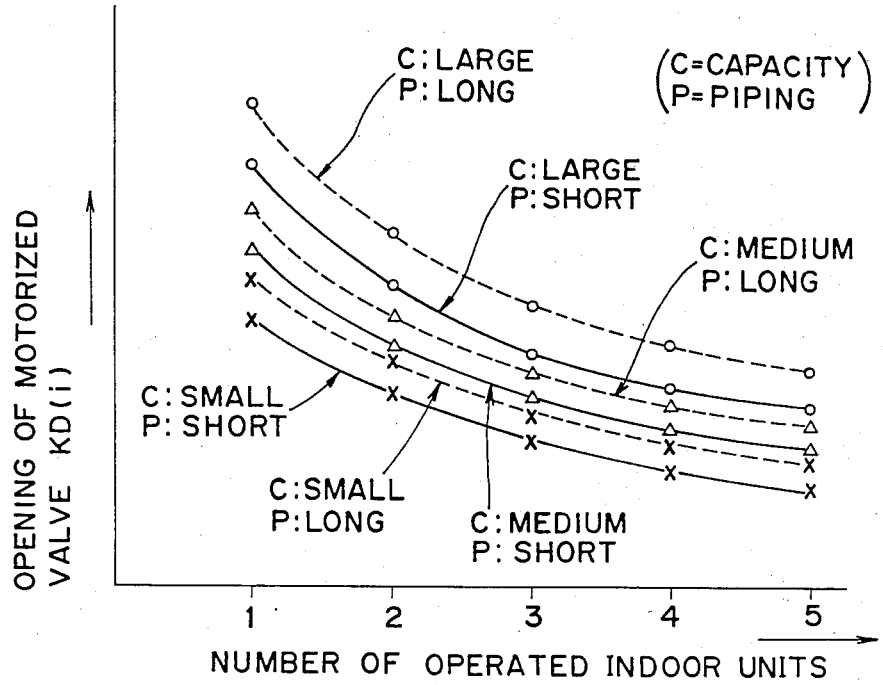
FIG. 3 is a graph to explain the opening of motorized valves.

The opening data A (j, k) generally shows the tendencies as shown in FIG. 3. That is, as the number of indoor units in operation increases, the circulation quantity of refrigerant per an indoor unit decreases; as the capacity of an indoor unit becomes large, the circulation quantity of refrigerant required increases; and the greater the length of piping, the larger the required opening of motorized valve because of the fluid friction. Therefore, the opening KD (i) needs to be set to a relatively larger value where the number of indoor units in operation is small, the capacity of indoor units in operation is relatively large and the length of piping is relatively great, whereas the opening KD (i) is set to a relatively small value in the reverse case.

Figure 4A:
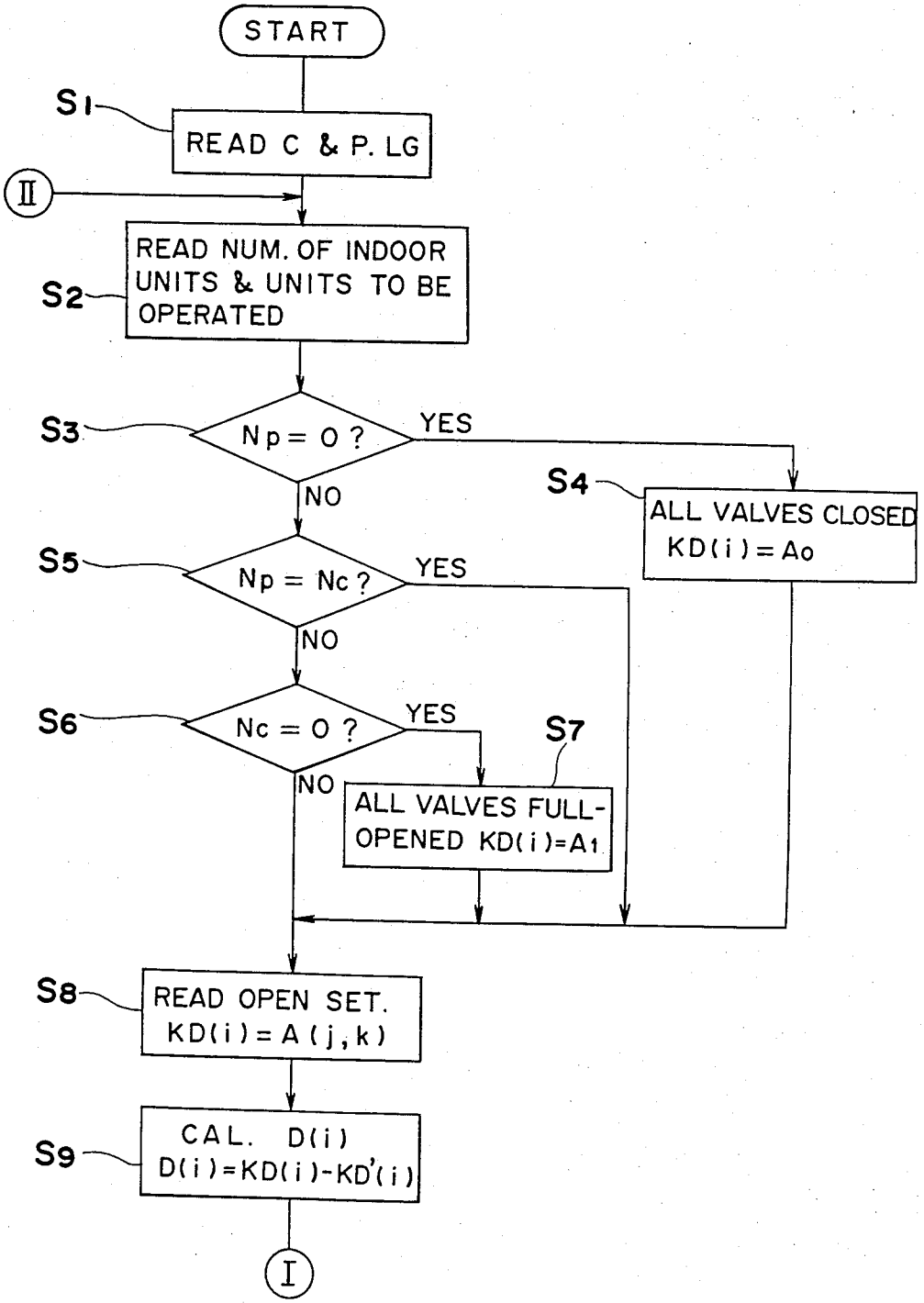
FIGS. 4*a* and 4*b* are flow charts of the control apparatus according to the invention.

Next, the operation of the control apparatus will be explained with reference to FIG. 4*a* and 4*b*. When all the indoor units A, B, C, D and E stop, and the operation request signal is absent, the compressor 1 is in an off-state and motorized valves 8*a*, 8*b*, 8*c*, 8*d* and 8*e* are fully opened. In this condition, when the operation request signal is outputted from any one of the indoor units, a scan output will be generated from the microcomputer 20 at step $S_1$ so that the data concerning the capacity of each indoor unit and piping length will be read through switches SW*a*, SW*b*, SW*c*, SW*d* and SW*e*. Next, at step $S_2$, the data concerning the number of indoor units required and the number of indoor units to be operated will be read through sensors 22*a*, 22*b*, 22*c*, 22*d* and 22*e*. Then, in order to discriminate if any one of the indoor units is in operation, it will be determined whether the number Np of indoor units required for operation was 0 or not. This operation is judged at step $S_3$, and, when it is judged that the number Np has been 0, the program proceeds to step $S_4$ and the previously set opening KD (i) of motorized valves 8*a*, 8*b*, 8*c*, 8*d* and 8*e* are set once as KD (i)=Ao in order to fully close the motorized valves 8*a*, 8*b*, 8*c*, 8*d* and 8*e* once or to zero the settings of all the motorized valves 8*a*, 8*b*, 8*c*, 8*d* and 8*e*. On the other hand, when the judgement at step $S_3$ is NO because any one of indoor units is in operation, whether the number Nc of indoor units in operation is equal to that Np of the indoor units for which the operation has been requested previously or not is judged at step $S_5$.

When the result of this judgement is NO because some of the indoor units are in operation, and the number Nc of the indoor units in operation is not equal to that Np at the time of the previous operation, the program proceeds to step $S_6$ in order to judge if the operations of all the indoor units are to be stopped or not at this stage, whether the number Nc of indoor units for which the operation is requested at this stage is zero or not is judged. When the result of this judgement is YES because all the indoor units are stopped, the program proceeds to step $S_7$ and the openings KD (i) of the motorized valves 8*a*, 8*b*, 8*c*, 8*d* and 8*e* for all the rooms are set as KD (i) $=A_1$ or the full opened position. Following the judgement and processing, at step $S_8$, the data KD (i) = A (j, k) concerning the opening of motorized valves 8*a*, 8*b*, 8*c*, 8*d* and 8*e* as are set in Table 1, according to the data of the capacities, piping lengths and the number of driven indoor units are read for indoor units A, B, C, D and E, respectively. Then, at step $S_9$, D (i) =KD (i)−KD′ (i), the difference between the opening data KD (i) and previously set opening data KD′ (i) is calculated.

Figure 4B:
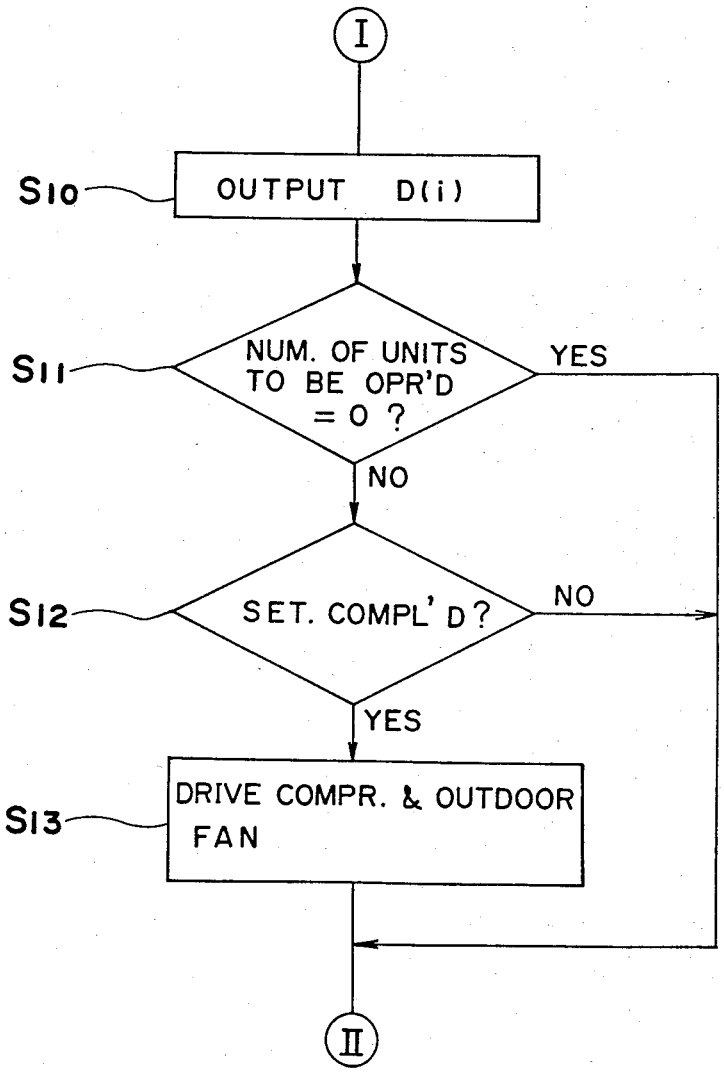

The program then proceeds to step $S_{10}$ as shown in FIG. 4*b* and the pulse signals corresponding to the opening to be varied for various indoor units according to this data D (i) are outputted sequentially to motorized valves 8*a*, 8*b*, 8*c*, 8*d* and 8*e* from a drive circuit 21 and the opening of these valves are adjusted to the necessary degrees. Then, the program proceeds to step $S_{11}$ in order to judge if the number of indoor units for which the operation requests have been made is zero or not, and, when the number is zero, the program returns to step $S_2$ to read the data concerning the number of indoor units required for the operation, and this processing will be repeated thereafter.

On the other hand, when the number of indoor units required for operation is found not to be zero at step $S_{11}$, the program proceeds to step $S_{12}$ to judge if the settings of the opening for indoor units required for the operation are completed or not. When the settings are found not to have been completed at step $S_{12}$, the program returns to step $S_2$. When the settings for the opening for the indoor units required for operation are found to have been completed at Step $S_{12}$, the program proceeds to step $S_{13}$. At step $S_{13}$, the microcomputer 20 outputs the signal for driving the compressor 1 to a relay 31 and also outputs the signal for driving an outdoor fan of outdoor unit F not shown in the drawing. Then, the program returns to step $S_2$.

Figure 5:
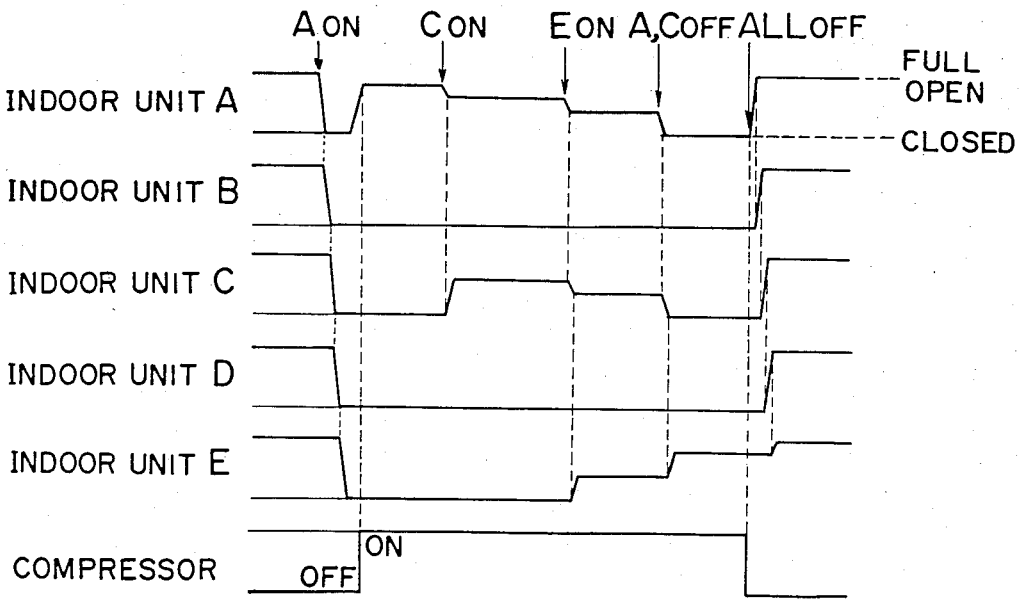
FIG. 5 is a diagram explaining the operation of motorized valves.

The aforementioned processes will be explained in detail with reference to FIG. 5. When only the indoor unit A is turned on while all the other indoor units are stopped, all motorized valves 8*a*, 8*b*, 8*c*, 8*d* and 8*e* which have been in fully opened state will be fully closed. After all the motorized valves 8*a*, 8*b*, 8*c*, 8*d* and 8*e* are fully closed, only the motorized valve 8a corresponding to the indoor unit A will be opened to the set opening in the case where "Number of indoor units required operation =1" while the other motorized valves 8*b*, 8*c*, 8*d* and 8*e* are kept fully closed. In this case, in order to prevent the erroneous operation of the valve owing to the noise from the compressor 1, said compressor 1 is driven on after the opening of motorized valve 8*a* corresponding to when the indoor unit A is completed.

When the number of indoor units required for operation has become two, for example, as the indoor unit C is turned on while the indoor unit A is on, the opening of motorized valve 8*a* is altered to the set opening in the case where "Number of indoor units required operation =2", and then the opening of motorized valve 8*c* corresponding to the indoor unit C will also be set to that applicable to the case where the number of indoor units required operation =2. Furthermore, when the indoor unit E is turned on, the opening of the motorized valves 8*a* and 8*c* corresponding to indoor units A and C will sequentially be set to those applicable to the case where the number of indoor units in operation =3, and then the opening of motorized valve 8*e* corresponding to the indoor unit E will also be set to that applicable to the case where the number of indoor units in operation =3. When indoor units A and C are turned off later, the motorized valves 8a and 8c corresponding to these indoor units A and C will be fully closed sequentially, and then the opening of motorized valve 8e corresponding to the indoor unit E will also be altered to that applicable to the case where the number of indoor units in operation =1. When the operations of all indoor units are stopped, the compressor 1 is turned off, and all the motorized valves 8*a*, 8*b*, 8*c*, 8*d* and 8*e* will be fully opened sequentially.

Therefore, in this embodiment, the opening of motorized valves 8*a*, 8*b*, 8*c*, 8*d* and 8*e* are controlled by steps according to the number of indoor units A, B, C, D and E of air conditioning system in operation, the capacities of indoor units A, B, C, D and E and the lengths of pipings, so that a complicated control system such as a feedback control with PID control action is not required, the control system can be simplified, and the optimum distribution of refrigerant to indoor units is set quickly and this helps the operations in a plurality of indoor units to be stabilized quickly. The control system being simple, the control circuit is also quite simple. Moreover, the control system does not require the refrigerant circuit with temperature sensors. Thus, the control apparatus according to this embodiment can be compactly designed and produced at low cost.

Furthermore, in said embodiment, the operating condition of air conditioning system is judged according to the number of indoor units required for operation, the capacities of indoor units and the piping lengths, but it is also possible to judge the operating condition of air conditioning system according to any one of them.

As explained in the foregoing, according to the present invention, the opening of motorized valves corresponding to indoor units can be controlled respectively to the predetermined degree according to the number of indoor units to be operated, so that the control apparatus according to the present invention can dispense with the complicated control system such as a feedback control with PID control action. Therefore, the control apparatus cannot only be extremely simplified because of the simple control but also a refrigerant circuit with temperature sensor is not required. As a result, the control apparatus according to the present invention features compactness and a low production cost.

The present invention being thus described, it will be obvious that the same may be varied in many ways. Such variations are not to be regarded as a departure from the spirit and the scope of the present invention, and all such modifications such as would be obvious to one skilled in the art are intended to be included within the scope of the following claims.

We claim:

1. A control apparatus for an air conditioning system comprising:

an outdoor unit which has a compressor, a condenser to receive refrigerant transferred from said compressor, a liquid refrigerant pipe which is connected to said condenser at one end thereof and is divided into a plurality of branch pipes at the other end thereof, and at least one motorized valve being disposed in each of the branch pipes, the motorized valves controlling a quantity of refrigerant flowing in said branch pipes;

a plurality of indoor units which have respective evaporators, and which are connected to individual branch pipes through connection pipes;

operation request signal output means for outputting an operation request signal indicating which of the indoor units is required to operate;

specifying means for specifying which indoor units are required to be operated in response to the request signal from the operation request signal output means, said specifying means outputting a signal indicative of the specified indoor units;

counting means for counting the number of the indoor units required to operate in accordance with the request signal from said operation request signal output means;

valve-opening control means provided with a table representing degrees of valve opening for each of the motorized valves, the degrees being predetermined relative to a number of indoor units required to operate in a manner that valve openings decrease in steps as the number of indoor units required to operate increases, the valve openings also increasing in steps as the number of indoor units required to operate decreases, the valve opening means looking up the table to get the degree of valve opening corresponding to the number of the indoor units decided by the counting means and based on the signal indicative of the indoor units, said valve-opening control means outputting a signal representative of the degree of valve opening; and drive circuit means for driving said motorized valves for the indoor units required to operate in response to the signal outputted from said specifying means and for controlling the motorized valves to open to the degree decided by the valve-opening control means in response to the signal outputted from the valve-opening control means.

2. The control apparatus for an air conditioning system as claimed in claim 1, further comprising capacity indicating means for selecting one value out of predetermined, discrete numerical values to set a capacity for each of said indoor units and for outputting a signal indicating the capacity, wherein the table represents degrees of valve opening for each of the motorized valves, the degrees being predetermined relative to the number of said indoor units required to operate and the capacity thereof in a manner that;

when the capacity is constant, the valve opening decreases in steps as the number of indoor units required to operate increases, and when the valve opening increases in steps as the number of indoor units required to operate decreases; and when a number of indoor units required to operate is constant, the opening of said motorized valves increases in steps as the capacity increases, and when the valve opening decreases in steps as the capacity increases;

said valve-opening control means looks up within the table of degree of valve opening corresponding to a combination of the number of indoor units required to operate and capacity decided based on the signal output from the counting means and the signal output from the capacity indicating means with respect to each of the indoor units required to operate, and outputs a signal indicative of the degree of valve opening.

3. The control apparatus for an air conditioning system as claimed in claim 1, further comprising pipe length indicating means for selecting one value out of predetermined, discrete numerical values to set a pipe length of each of the connection pipes and for outputting a signal indicating the pipe length, wherein the table represents degrees of valve opening for each of the motorized valves, which degrees are predetermined relative to the number of said indoor units required to operate and the pipe length of the connection pipes in a manner that;

when the pipe length of the connection pipe is constant, the valve opening decreases in steps as the number of indoor units required to operate increases, and when the valve opening increases in steps as the number of indoor units required to operate decreases; and when the number of indoor units required to operate is constant, the valve opening increases in steps as the length of the connection pipes increases in steps, and when the valve opening decreases in steps as the length of connection pipe decreases;

said valve-opening control means looks up within the table the degree of valve opening for a combination of the number of indoor units required to operate and pipe length of the connection pipes decided based on the signals from the counting means and length indicating means with respect to each of the indoor units required to operate, and outputs a signal indicative of the degree of valve opening.

4. The control apparatus for an air conditioning system as claimed in claim 1, further comprising capacity indicating means for selecting one value out of predetermined, discrete numerical values to set a capacity for each of the indoor units and for outputting a signal indicating the capacity, and further comprising pipe length indicating means for selecting one value out of predetermined, discrete numerical values to set a pipe length of each of the connection pipes and for outputting a signal indicating the pipe length, wherein the table represents degrees of valve opening for each of the motorized valves, which degrees are predetermined relative to the number of indoor units required to operate, the capacity of the indoor units and the pipe length of the connection pipes in a manner that;

when the capacity of the indoor units required to operate is constant and the pipe length of the connection pipes are constant, the valve opening decreases in steps as the number of the indoor units increases, and when the valve opening increases in steps as the number of indoor units decreases;

when the number of the indoor units required to operate and the pipe length of the connection pipes are constant, the valve opening increases in steps as the capacity of the indoor units increases, and when the valve opening decreases in steps as the capacity of the indoor units increases; and when the number of the indoor units required to operate is constant and the capacity of the indoor units are constant the valve opening increases in steps as the pipe length of the connection pipe increases and the valve opening decreases in steps as the pipe length of the connection pipe decreases;

said valve-opening control means looks up within the table the degree of valve opening for a combination of the number of the indoor units required to operate, capacity of the indoor units and pipe length of the connection pipes decided based on the signals from the counting means, capacity indicating means and pipe length indicating means with respect to each of the indoor units required to operate, and outputs signals indicative of the degree of valve opening.

* * * * *